US006770193B2

(12) United States Patent
Foley

(10) Patent No.: US 6,770,193 B2
(45) Date of Patent: Aug. 3, 2004

(54) POOL SKIMMER BARRIER DEVICE

(76) Inventor: Kevin T. Foley, 2877 Keasler Cir., Germantown, TN (US) 38139

( * ) Notice: Subject to any disclaimer, the term of this patent is extended or adjusted under 35 U.S.C. 154(b) by 0 days.

(21) Appl. No.: 10/318,379

(22) Filed: Dec. 13, 2002

(65) Prior Publication Data

US 2004/0011717 A1 Jan. 22, 2004

Related U.S. Application Data

(60) Provisional application No. 60/396,098, filed on Jul. 17, 2002.

(51) Int. Cl.[7] ..... E04H 4/16
(52) U.S. Cl. ..... 210/169; 4/496
(58) Field of Search ..... 210/169, 232; 15/1.7; 4/496

(56) References Cited

U.S. PATENT DOCUMENTS

| | | | | |
|---|---|---|---|---|
| 2,900,079 | A | | 8/1959 | Pace |
| 4,140,634 | A | | 2/1979 | Harry |
| D259,739 | S | | 6/1981 | Johnson |
| 4,501,659 | A | | 2/1985 | Henk |
| 4,545,905 | A | | 10/1985 | Poe |
| 5,078,863 | A | | 1/1992 | Durigon |
| 5,259,076 | A | | 11/1993 | Voight et al. |
| D365,381 | S | | 12/1995 | Hoeppner |
| 5,626,747 | A | | 5/1997 | Ritzow et al. |
| 5,753,113 | A | * | 5/1998 | Hendricks ..... 210/169 |
| 5,833,845 | A | | 11/1998 | Anderson |
| 5,935,450 | A | * | 8/1999 | Benedict ..... 210/776 |
| D433,152 | S | | 10/2000 | Masciarelli |
| 6,162,407 | A | | 12/2000 | Pihl |
| 6,214,217 | B1 | | 4/2001 | Sliger, Jr. |

* cited by examiner

*Primary Examiner*—Fred G. Prince
(74) *Attorney, Agent, or Firm*—Nixon & Vanderhye, P.C.; Frank P. Presta

(57) ABSTRACT

A barrier device for a pool to prevent debris on the pool water surface from entering the pool skimmer intake. The barrier device comprises a first or upper section of a size and shape to fit on or in the skimmer intake, and a second or lower hollow section connected to and in communication with the first section. The second section depends from the first section and has a lower end that is positioned to be disposed below the pool water surface when the first section is positioned in the skimmer intake. In this manner, pool water can circulate from the lower end of the second section, through the second and first sections and into the skimmer intake. Debris on the pool water surface is prevented from entering the skimmer intake by the outer wall of the first section or the second section, depending on the construction thereof. The outer wall of the first or second section may be provided with one or more screened holes positioned to be disposed below the pool water surface. A receptacle such as a screen or net may be removably mounted on the first or second section to receive debris on the pool water surface.

19 Claims, 6 Drawing Sheets

POOL SKIMMER BARRIER DEVICE

CROSS-REFERENCE TO RELATED APPLICATION

The present application includes the subject matter and claims the priority of Provisional Patent Application No. 60/396,098 filed on Jul. 17, 2002.

BACKGROUND OF THE INVENTION

The present invention relates to a barrier device for a pool skimmer which is constructed to prevent leaves and other debris in the pool from entering the pool skimmer basket.

In most swimming pools, leaves and other debris in the pool can enter the pool skimmer intake and fill the pool skimmer basket to block the flow of water back to the pump. In such cases, the pump fills with air and ceases to pump water. If this continues, the pump motor can burn up. Also, if a pool owner runs the pool during colder weather, the pool equipment (pump, heater, valves, etc.) can freeze and sustain significant damage when the flow of water ceases.

Various types of screen or filter devices have been disclosed or used in the prior art for preventing leaves and other debris from entering a pool skimmer basket or the like. While they have generally served their purpose, they have been subject to one or more of the following disadvantages:

1. They have been complicated in construction;
2. They have been expensive to manufacture;
3. They have been large and unsightly;
4. They have easily become clogged if not frequently emptied of debris;
5. They have not been durable;
6. They have been difficult to install in a pool; and/or
7. They have not maintained a flow of water through the pool pump if blocked by debris.

The new and improved barrier device of the present invention is not subject to any of the above-listed disadvantages and possesses certain advantages not found in the prior art devices.

SUMMARY OF THE INVENTION

A principal object of the present invention is to provide a simple and practical barrier device for a pool skimmer which prevents the flow of leaves and other debris into the pool skimmer basket and insures continued circulation of water between the pump and the swimming pool.

In accordance with the present invention, the barrier device comprises an upper laterally extending section and a lower depending section that may be hollow and in communication with each other to enable the flow of water from the bottom of the lower section to the outer end of the upper section. The barrier device is installed in a pool by inserting the upper section in the pool skimmer intake such that the lower section is disposed adjacent to or near the pool wall extending downwardly from the skimmer intake. In this manner, the bottom of the lower section is located beneath the surface of the water in the pool and the pool water circulates from the bottom of the lower section, through the upper section, through the skimmer basket, and back to the pool. In one embodiment, the outer wall of the lower section prevents debris on the pool water surface from entering the skimmer intake and thereby insures that the skimmer basket will not become clogged with debris. It also insures that a free flow of water continues through the skimmer, preventing air from entering and clogging the system.

In another embodiment, the outer wall of the upper section prevents debris from entering the skimmer intake and the lower section is in the form of one or more conduits of any suitable shape extending downwardly from the outer wall of the upper section into the pool water below the upper surface thereof.

In a further embodiment, a receptacle such as a net or screen may be removably mounted on the barrier device adjacent the outer wall thereof and below the pool water surface for receiving debris accumulating on the pool water surface adjacent the outer wall of the lower section. One or more screened holes may be provided in the outer wall just below the pool water surface to create a current to draw debris into the receptacle.

DESCRIPTION OF THE PREFERRED EMBODIMENTS

Figure 2:
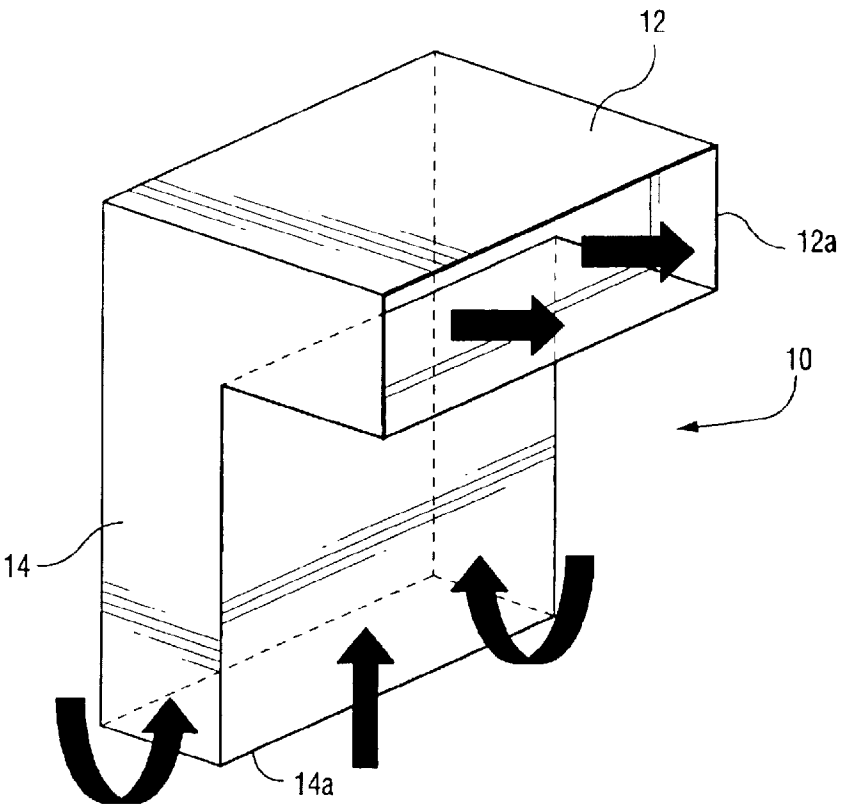
FIG. 2 is a perspective view similar to FIG. 1, showing the direction of water flow through the barrier device when it is installed in a pool skimmer.
Figure 1:
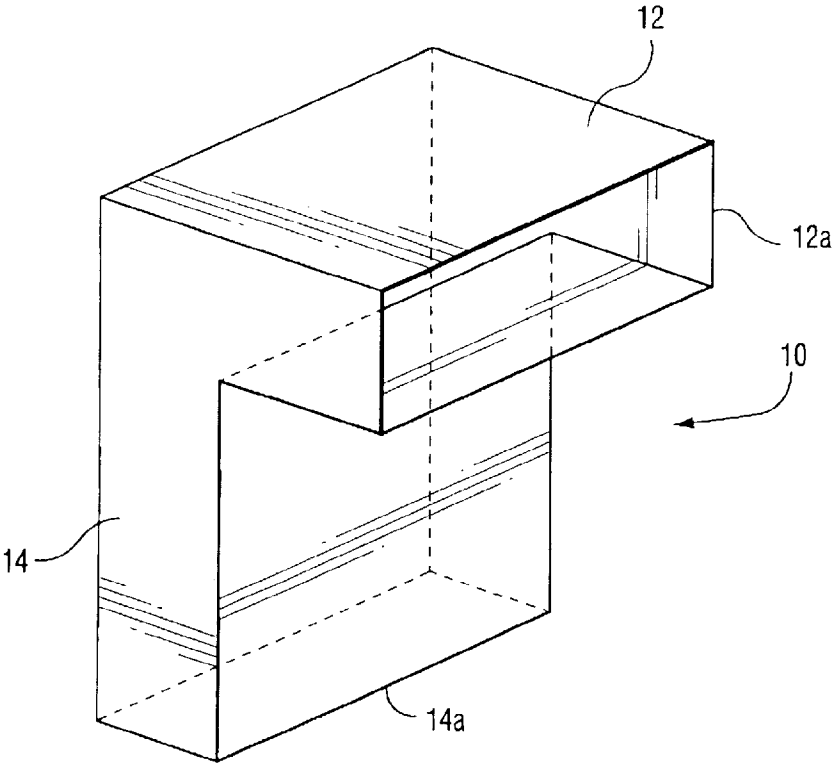
FIG. 1 is a perspective view of the rear portion of a first embodiment of the pool skimmer barrier device of the present invention.

As shown in FIG. 1, in a first embodiment the pool skimmer barrier device 10 of the present invention may be generally L-shaped and comprises an upper or first laterally extending section 12 and a lower or second depending section 14 that are hollow and in communication with each other to enable the flow of water from the bottom 14*a* of the lower section 14 to the outer end 12*a* of the upper section 12, as shown in FIG. 2. It is noted that the term "L-shaped" is meant to encompass any suitable angle and size differences between the upper and lower sections 12, 14 that may be necessary for mounting the barrier device in a particular pool construction or for the proper operation thereof.

The barrier device 12 is formed of any suitable material, such as a durable plastic, which will not deteriorate when immersed in or exposed to water.

Figure 3:
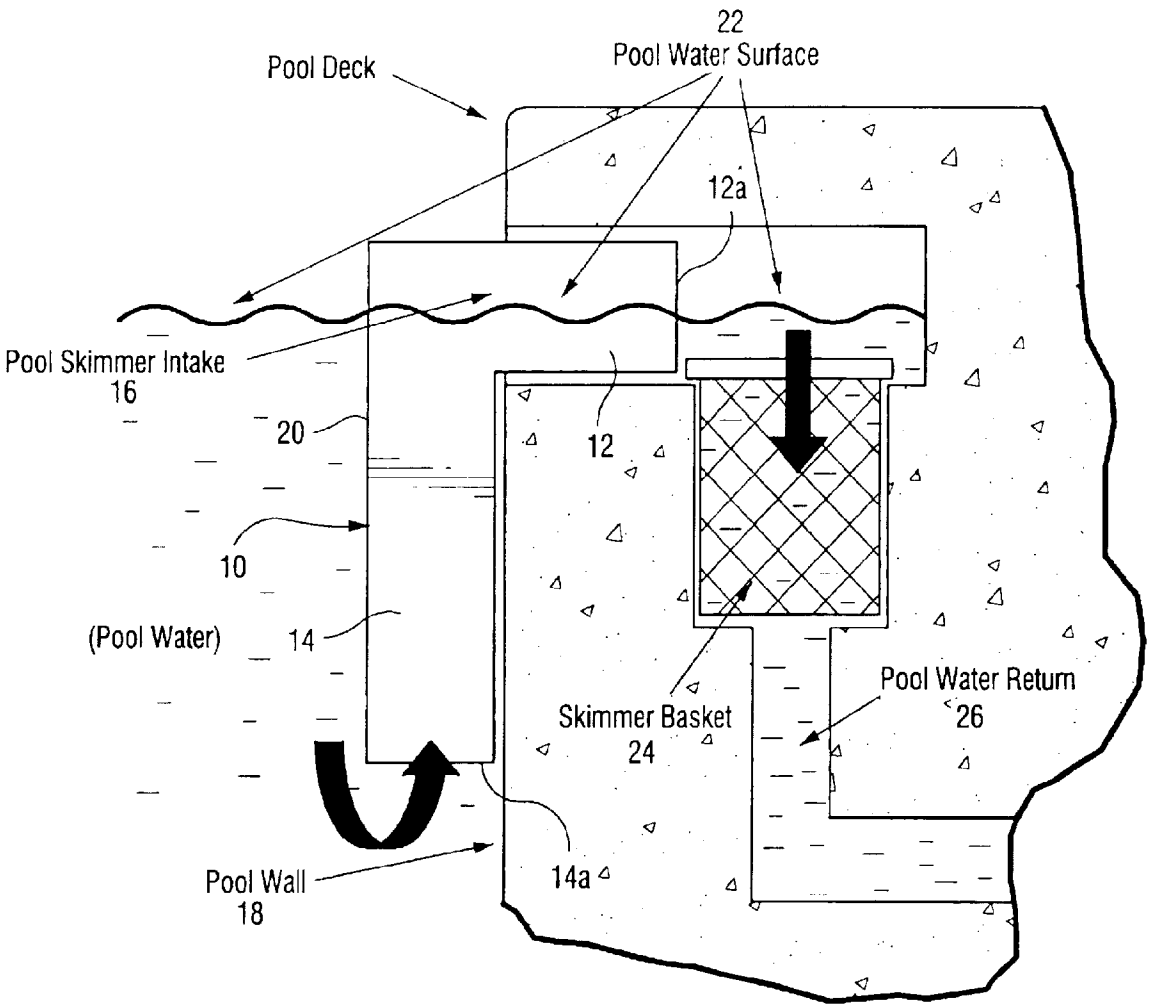
FIG. 3 is a side elevational view showing the barrier device of FIGS. 1 and 2 installed in a pool skimmer.

Referring to FIG. 3, which shows the barrier device 10 installed in a swimming pool skimmer, the upper section 12 of the barrier device is inserted in the pool skimmer intake 16 and the lower section 14 is disposed adjacent the pool wall 18 extending downwardly from the pool skimmer intake 16. The outer wall 20 of the lower section 14 prevents leaves or other debris on the pool water surface 22 from entering the pool skimmer intake 16, thereby insuring the continued circulation of pool water through the skimmer basket 24 and pool water return 26 to the pump (not shown) and then back to the pool.

The pool water enters the lower end 14*a* of the lower section 14 of the barrier device 10 and flows upwardly therethrough to the outer end 12*a* of the upper section 12 of the barrier device, as shown in FIG. 3. The circulating pool water then enters the skimmer basket 24 substantially free of debris and flows through the pool water return 26 to the pump (not shown).

It is noted that the barrier device 10 may have any suitable shape and may be of any suitable size so that it can be conveniently mounted in the skimmer intake of a swimming pool to prevent debris from entering the skimmer intake and to allow the circulation of water from beneath the pool surface through the barrier device, the skimmer intake and the skimmer basket. The upper section 12 may be of a size and shape substantially the same as that of the skimmer intake 16, so that it can be slidably mounted therein. Also, any suitable type of connecting means (not shown) may be used to removably connect the barrier device 10 to the adjacent portion of the pool in any suitable manner.

Figure 4:
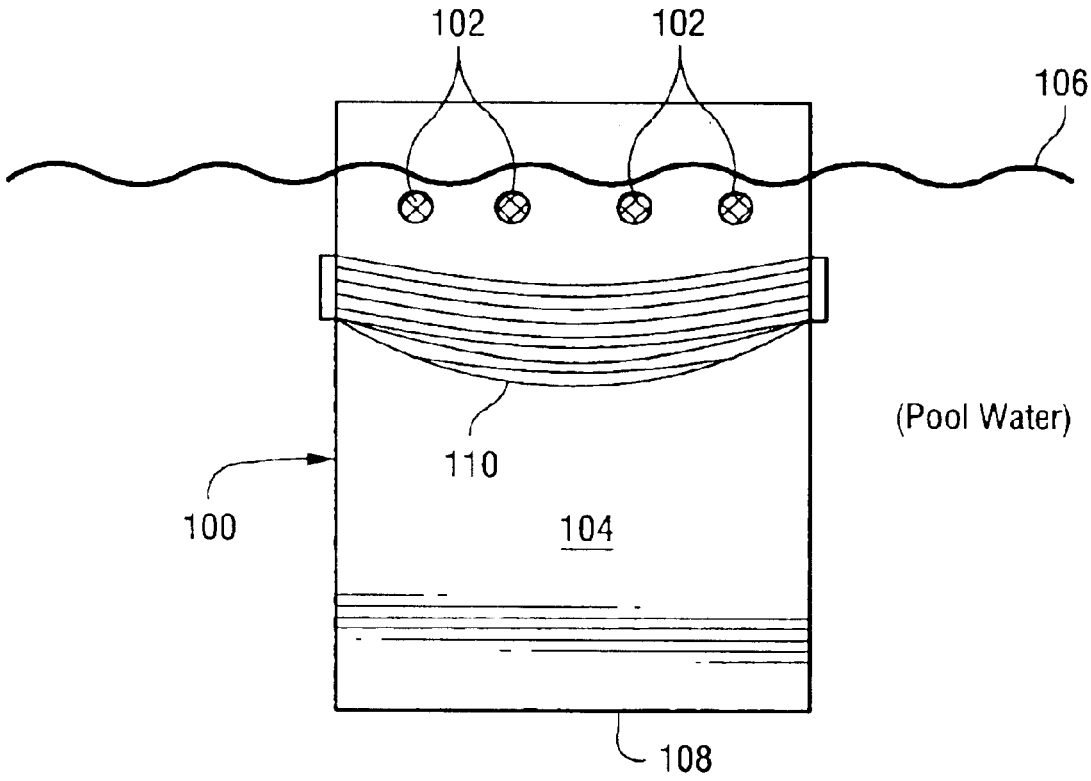
FIG. 4 is a front elevational view of a second embodiment of the pool skimmer barrier device of the present invention.

FIG. 4 illustrates another embodiment of a pool skimmer barrier device 100 constructed in accordance with the principles of the present invention. The barrier device 100 comprises one or more screened holes 102 in the outer wall 104 thereof which are disposed just below the pool water surface 106 when the barrier device 100 is installed in a pool skimmer. Pool water will circulate through the screened holes 102 and through the bottom 108 of the barrier device 100 into the skimmer intake (not shown) and debris on the pool water surface will be prevented from entering the skimmer intake.

A receptacle 110, such as a net or screen, is removably mounted in any suitable manner on the outer wall 104 below the screened holes 102 for the purpose of catching debris that accumulates against the outer wall 104 near the screened holes 102 and the pool water surface 106. The receptacle 110 may be of any suitable construction. The flow of water through the screened holes 102 creates a current to help draw debris into the receptacle 110.

In accordance with a further embodiment, the receptacle 110 may be removably mounted on the barrier device 10 shown in FIGS. 1–3 which does not have any screened holes in the outer wall 20 thereof.

Figure 5:
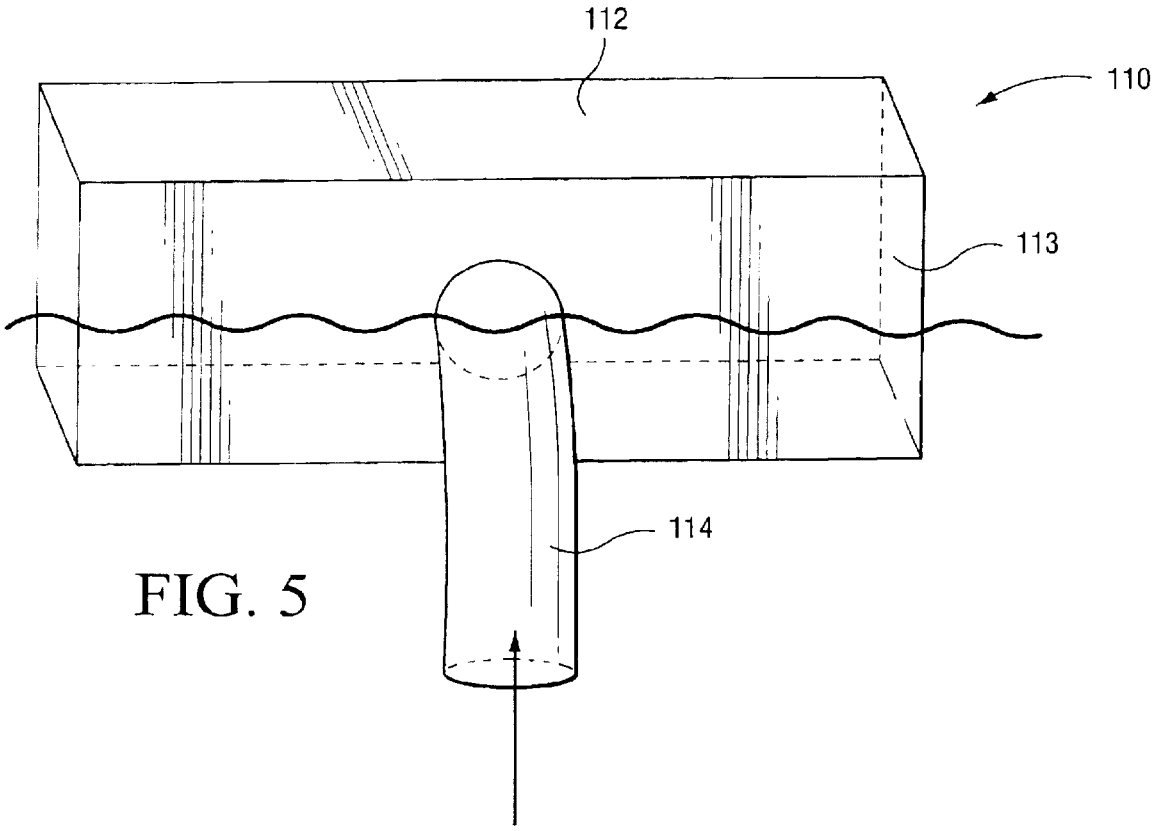
FIG. 5 is a perspective view of the front portion of a further embodiment of the pool skimmer barrier device of the present invention.
Figure 6:
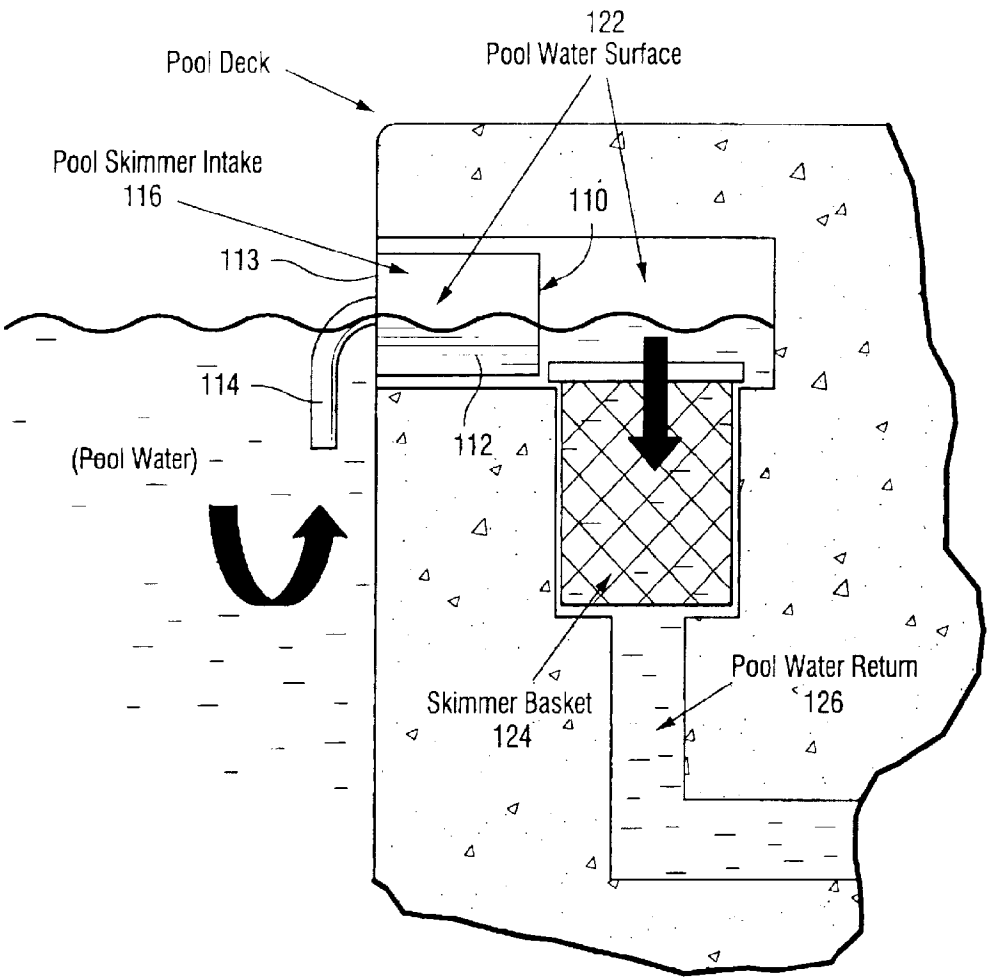
FIG. 6 is a side elevational view showing the barrier device of FIG. 5 installed in a pool skimmer.

A still further embodiment of the pool skimmer barrier device 110 is shown in FIGS. 5 and 6. In this embodiment, the barrier device 110 comprises a hollow upper section 112 and a hollow lower section in the form of at least one conduit 114 of any suitable shape that is connected to the outer wall 113 of the upper section 112 and extends downwardly therefrom. The conduit 114 is in communication with the interior of the upper section 112. Preferably, the size and shape of the upper section 112 are such that it can be conveniently mounted or inserted in the skimmer intake of a swimming pool. The inner portion of the upper section 112 is open to allow water flow from the conduit 114 through the upper section and into the pool skimmer.

As shown in FIG. 6 the upper section 112 is inserted in the pool skimmer intake 116 and the conduit 114 extends downwardly from the outer wall 113 of the upper section below the surface 122 of the pool water. In the case of multiple conduits 114, they may be of the same or different lengths. The outer wall 113 of the upper section 112 prevents leaves or other debris on the pool water surface 122 from entering the pool skimmer intake 116, thereby insuring the continued circulation of pool water from the bottom of the conduit 114, through the upper section 112, through the skimmer basket 124 and pool water return 126 to the pump (not shown) and then back to the pool.

Figure 7:
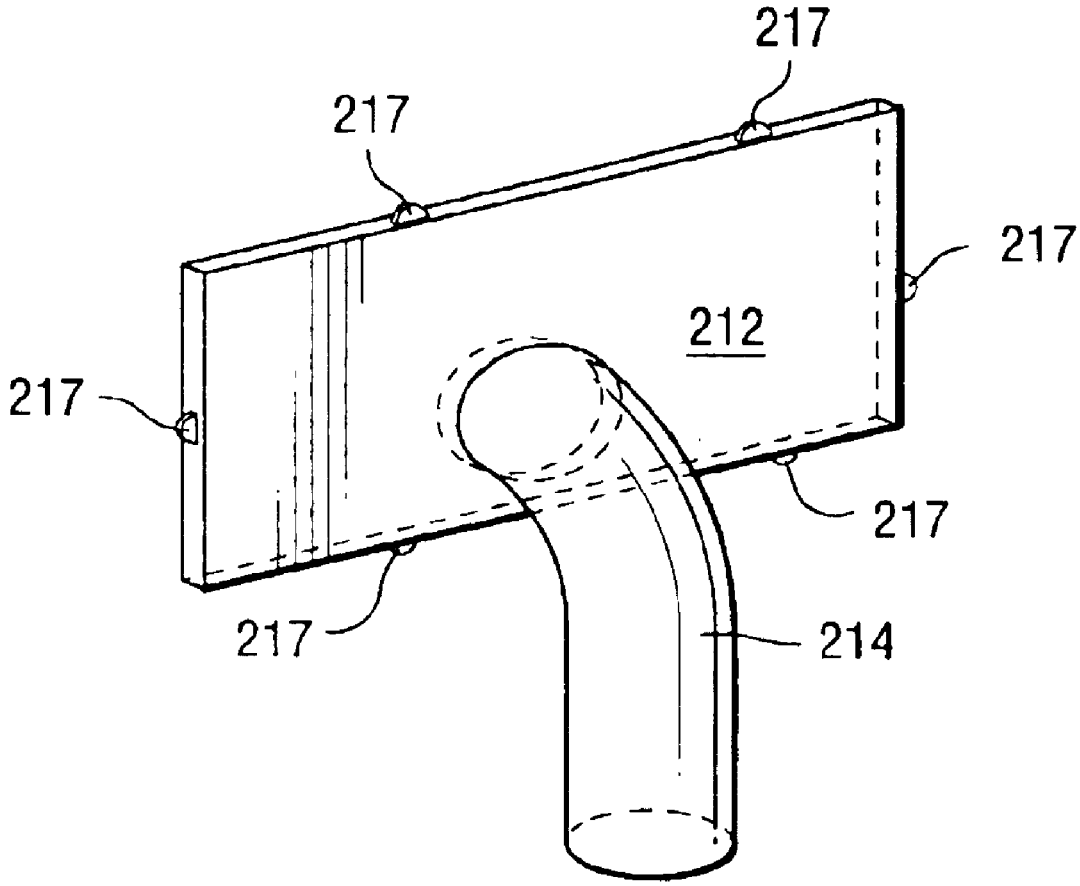
FIG. 7 is a perspective view of still another embodiment of the pool skimmer device that is similar to that shown in FIGS. 5 and 6.

FIG. 7 illustrates a modified form of the barrier device shown in FIGS. 5 and 6. In this modified embodiment, the upper section 212 is in the form of a wall and the conduit 214 is connected to and extends downwardly from the upper section 212. The upper section 212 may be provided with any suitable devices, such as spring clips 217, for removably mounting it in or over the pool skimmer intake 216.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A barrier device for a pool to prevent debris on the pool water surface from entering the pool skimmer intake, said barrier device comprising a first section formed of a substantially impervious material and being of a size and shape adapted to fit on or in the skimmer intake, and a second hollow section formed of a substantially impervious material and being connected to and in communication with said first section, said second section depending from said first section and having a lower end that is positioned to be disposed below the pool water surface when said first section is positioned on or in the skimmer intake, whereby pool water can flow from said lower end of said section, through said second and first sections and into the skimmer intake, and debris on the pool water surface is prevented from entering the skimmer intake.

2. The barrier device of claim 1, wherein said first and second sections are hollow and are disposed at an angle to each other such that aid barrier device is generally L-shaped.

3. The barrier device of claim 2, wherein said first and second sections are substantially perpendicular to each other.

4. The barrier device of claim 1, wherein said first section has a size and shape that is similar to that of the pool skimmer intake.

5. The barrier device of claim 4, wherein said first section is adapted to be slidably mounted in the pool skimmer intake.

6. The barrier device of claim 1, wherein said first and second sections are formed integrally with each other of a durable plastic material.

7. The barrier device of claim 1 wherein said second section has an outer wall that prevents debris from entering the skimmer intake when the first section is mounted therein.

8. A barrier device for a pool to prevent debris on the pool water surface from entering the pool skimmer intake, said barrier device comprising a first section of a size and shape adapted to fit on or in the skimmer intake, and a second hollow section connected to and in communication with said first section said second section depending from said first section and having a lower end that is positioned to be disposed below the pool water surface when said first section is positioned on or in the skimmer intake, whereby pool water can flow from said lower end of said second section, through said second and first sections and into the skimmer intake, and debris on the pool water surface is prevented from entering the skimmer intake;

wherein a receptacle is removably mounted on the device to receive therein debris on the pool water surface that cannot enter the pool skimmer intake.

9. The barrier device of claim 8, wherein said device has at least one screened hole therethrough positioned to be just below the pool water surface when said first section is disposed in the skimmer intake, the flow of water through said screened hole serving to create a current to draw debris on the pool water surface into said receptacle.

10. The barrier device of claim 8, wherein said replaceable is a screen.

11. The barrier device of claim 8, wherein said receptacle is a net.

12. The barrier device of claim 8, wherein said device has a plurality of screened holes therethrough positioned to be just below the pool water surface when said first section is disposed in the skimmer intake.

13. A barrier device for a pool to prevent debris on the pool water surface from entering the pool skimmer intake, said barrier device comprising a first section of a size and shape adapted to fit on or in the skimmer intake, and a second hollow section connected to and in communication with said first section said second section depending from said first section and having a lower end that is positioned to be disposed below the pool water surface when said first section is positioned on or in the skimmer intake, whereby pool water can flow from said lower end of said second section, through said second and first sections and into the skimmer intake, and debris on the pool water surface is prevented from entering the skimmer intake;

wherein said second hollow section comprises one or more conduits.

14. The barrier device of claim 13 wherein said first section has an outer wall that prevents debris from entering the skimmer intake when the first section is mounted therein.

15. A barrier device for a pool to prevent debris on the pool water surface from entering the pool skimmer intake, said barrier device comprising a first wall section formed of a substantially impervious material and being adapted to fit over or be mounted in the skimmer intake, and a second hollow section formed of a substantially impervious material and being connected to and in communication with said first section, said second section depending from said first section and having a lower end that is positioned to be disposed below the pool water surface when said first section is positioned over or in the skimmer intake, whereby pool water can flow from said lower end of said second section, through said second and first sections and into the skimmer intake, and debris on the pool water surface is prevented from entering the skimmer intake.

16. The barrier device of claim 15 wherein said first wall section prevents debris from entering the skimmer intake when it is positioned over or in the skimmer intake.

17. A barrier device for a pool to prevent debris on the pool water surface from entering the pool skimmer intake, said barrier device comprising a first wall section adapted to fit over or be mounted in the skimmer intake, and a second hollow section connected to and in communication with aid first section, said second section depending from said first section and having a lower end that is positioned to be disposed below the pool water surface when said first section is positioned over or in the skimmer intake, whereby pool water can flow from said lower end of said second section, through said second and first sections and into the skimmer intake, and debris on the pool water surface is prevented from enter the skimmer intake;

wherein said second hollow section comprises one or more conduits.

18. A barrier device for a pool to prevent debris from entering the pool skimmer intake, said barrier device comprising a first section formed of a substantially impervious material and being adapted to fit over or in the skimmer intake, and a second lower and hollow section formed of a substantially impervious material and being constructed to extend below the pool water surface when said first section is positioned over or in the skimmer intake, whereby pool water can flow upwardly through said second section and said first section into the skimmer intake, and debris on the pool water surface is prevented from entering the skimmer intake.

19. The barrier device of claim 18 wherein said first section is of a size and shape that are complementary to the size and shape of the skimmer intake.

* * * * *